United States Patent [19]

Labelle et al.

[11] Patent Number: 4,944,169

[45] Date of Patent: Jul. 31, 1990

[54] CLOSURE LOCK

[75] Inventors: H. M. Robert Labelle, Cornwall; Norman H. Cant, Bainsville, both of Canada; Cecil M. Garrow, Hogansburg, N.Y.

[73] Assignee: Martinray Industries Ltd., Cornwall, Canada

[21] Appl. No.: 453,792

[22] Filed: Dec. 20, 1989

[51] Int. Cl.[5] ..... E05B 65/08; E05C 1/02

[52] U.S. Cl. ..... 70/100; 292/179; 292/42

[58] Field of Search ..... 70/90, 99, 100; 292/179, 177, 32, 41, 42, 43, DIG. 46; 100/84.1

[56] References Cited

U.S. PATENT DOCUMENTS

| | | | |
|---|---|---|---|
| 3,082,617 | 3/1963 | Kerman | 70/90 |
| 3,649,060 | 3/1972 | Ruff | 292/42 |
| 4,475,313 | 10/1984 | Governale | 292/42 |
| 4,559,880 | 12/1985 | Lacker | 70/118 |
| 4,694,669 | 9/1987 | Schualb | 70/100 |

*Primary Examiner*—Robert L. Wolfe

[57] ABSTRACT

A closure lock for a folding door having top and bottom locking bars in the tubular post at the leading end of the door. The locking bars are normally biased to an unlocked position within the door. The bars can be manually moved to project from the ends of the post in a locked position. A single locking finger in the post automatically holds the locking bars in their locked position. A cylinder lock on each side of the post can be operated to move the locking finger to a position allowing the locking bars to withdraw to an unlocked position.

10 Claims, 3 Drawing Sheets

CLOSURE LOCK

BACKGROUND OF THE INVENTION

1. Field of the Invention

This invention is directed toward an improved closure lock of the type that has locking bars projectable from opposite sides of a closure.

The invention is more particularly directed toward an improved closure lock of the above type used on the leading end of a folding closure.

2. Description of the Prior Art

In folding closures of the type that move horizontally to close an opening it is particularly important to ensure that the upper and lower corners of the closure at its leading end are locked, when the closure is in its closed position. This prevents forcible movement of the corners away from the closure frame which might permit unwanted entry. It is known to provide such closures with closure locks which incorporate locking bars movable in opposite directions from the top and bottom of the closure, at its leading end, to lock the upper and lower corners of the closure. Individual cylinder locks are normally provided for each locking bar, top and bottom, and normally, these cylinder locks are only accessible from one side of the door.

To improve these closure locks, it is known to provide a closure lock incorporating top and bottom locking bars within a post at the leading end of the closure. The top and bottom locking bars are each individually manully moved to a locked position when the closure is closed. A single cylinder lock, on either side of the closure, can be operated to unlock both locking bars. Thus the locking bars on the closure can be unlocked with a single operation from either side of the closure. Such a closure lock is shown in U.S. Pat. No. 4,694,669. This known closure lock is however complicated in construction making it relatively expensive, and difficult to service.

SUMMARY OF THE INVENTION

It is the purpose of the present invention to provide an improved closure lock, for a folding closure, of the type employing top and bottom locking bars unlocked with a single cylinder lock, from either side of the closure. The improved closure lock of the present invention employs a single locking pin to retain both the top and bottom locking bars in the locked position. The use of a single locking pin greatly simplifies the construction, operation and servicing of the closure lock making it less expensive than known closure locks.

The invention is particularly directed toward a closure lock for a closure of the type having a tubular post at its leading end. The closure lock has two locking bar assemblies mounted within the post, each locking bar assembly having a locking bar at one end and a strap at its other end. The locking bars project in opposite directions within the post and the straps overlap. Each locking bar assembly is movable longitudinally within the post between a locked position where the locking bar projects from the post and an unlocked position where the locking bar is withdrawn in the post. A locking pin is provided within the middle of the post, movable transversely of the post between a locked and unlocked position. The locking pin, in its locked position, cooperates with the overlapped straps of the locking bar assemblies, when they are in their locked position, to prevent longitudinal movement of the locking bar assemblies within the post.

DESCRIPTION OF THE PREFERRED EMBODIMENT

Figure 1:
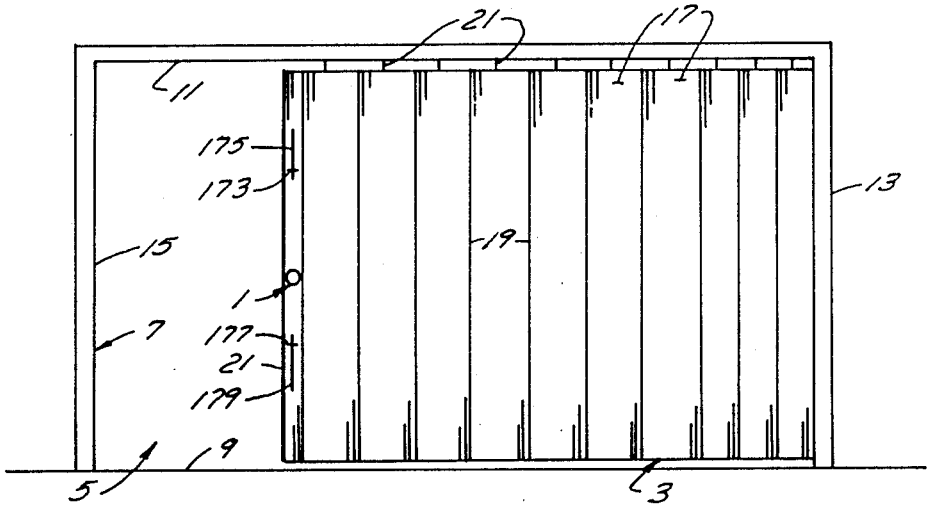
FIG. 1 is a front view of a closure incorporating the closure lock of the present invention.

The closure lock 1 of the present invention, as shown in FIG. 1, is typically used on a folding closure 3 that closes an opening 5 normally defined by a frame 7 and a floor 9. The frame 7 has a top frame member 11 and side frame members 13, 15. The closure 3 comprises a set of vertical panels 17 hingedly connected together by vertical hinges 19. The closure 3 is movably suspended from the top frame member 11 by hangers 21 and is fixed at one end to one side frame member 13. The closure 3 is moved across the opening 5 to close it with its leading end 21 abutting the other side frame member 15.

Figure 3:
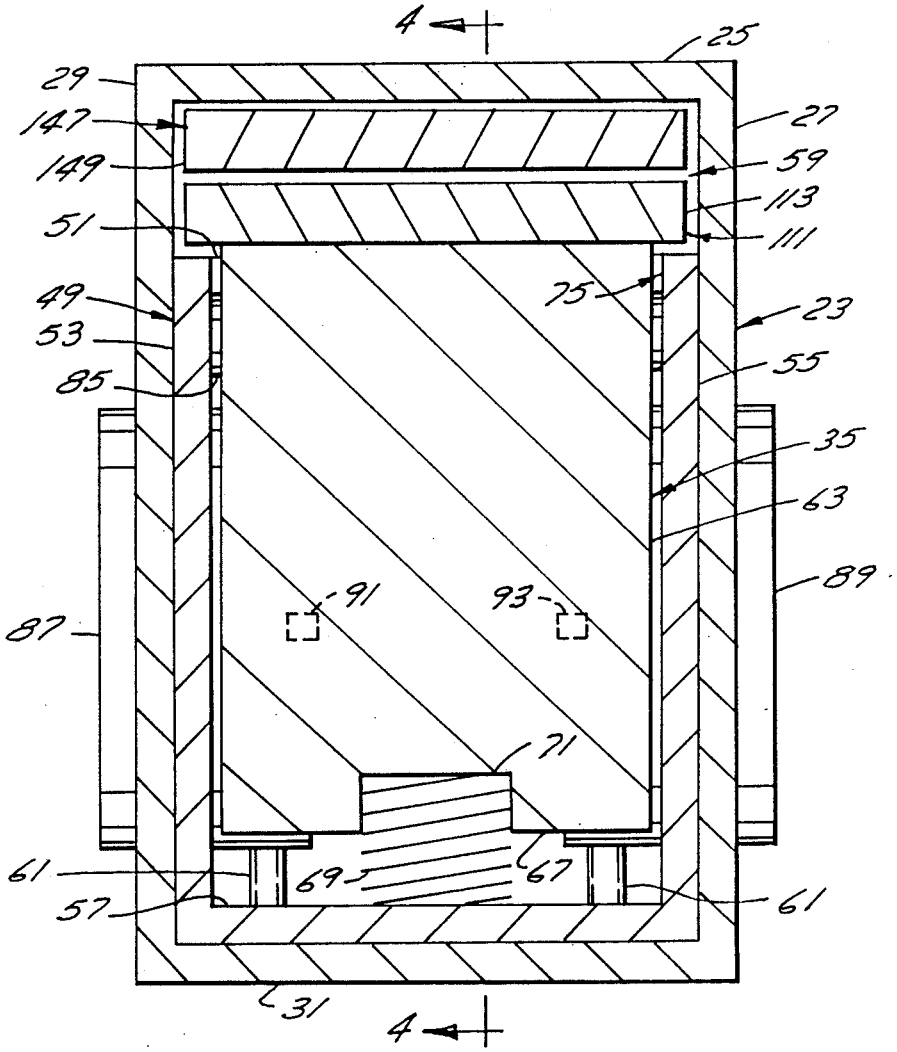
FIG. 3 is a cross-section view taken along line 3—3 in FIG. 2 showing the locking pin in its unlocked position.
Figure 2:
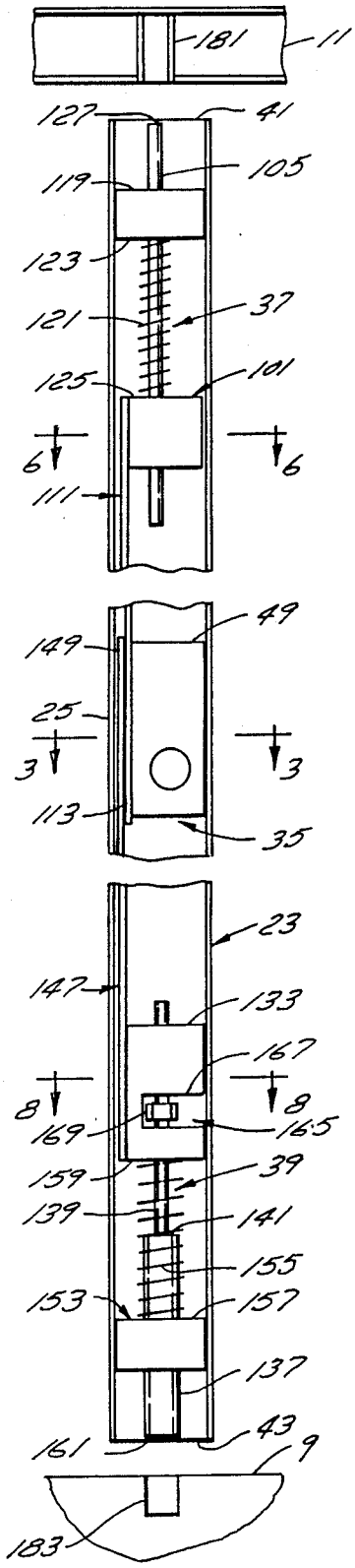
FIG. 2 is a view of the post on the leading end of the closure, with one sidewall removed to show details of the closure lock.

The leading end 21 of the closure 3 as shown in FIGS. 2 and 3 is defined by a tubular post 23. The post 23 has a rectangular cross-section with a first narrow sidewall 25, second and third wide sidewalls 27, 29 and a fourth narrow sidewall 31 opposite the front sidewall 25. The closure lock 1 is mounted within the post 23 and has a locking pin assembly 35 located in the middle of the post, and two locking bar assemblies 37, 39 extending from the middle ofthe post to its opposite ends 41, 43.

Figure 4:
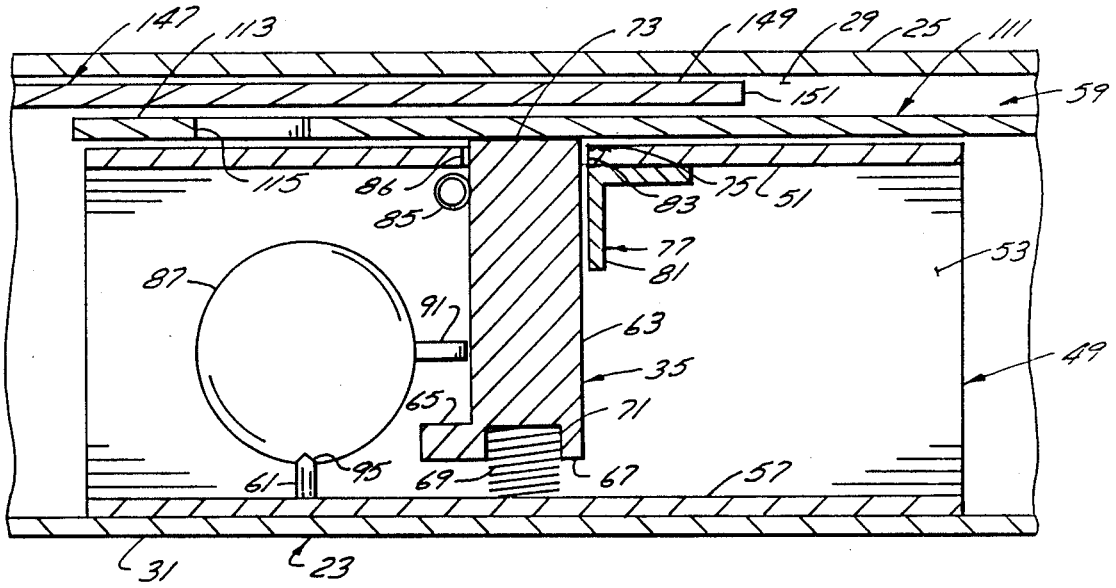
FIG. 4 is a partial cross-section view taken along line 4—4 in FIG. 3.

The locking pin assembly 35 has a relatively short tubular sleeve 49 fixedly mounted within the post 23 at its middle portion. The tubular sleeve 49, as shown in FIGS. 3 and 4, has a rectangular cross-section with a first, narrow sidewall 51, second and third wide adjacent sidewalls 53, 55 and a fourth narrow sidewall 57 opposite the first sidewall 51. The first sidewall 51 is spaced a short distance from the first sidewall 25 of the post 23 forming a narrow guide channel 59 between them. The other sidewalls 53, 55, 57 of the sleeve 49 lie adjacent sidewalls 27, 29, 31 respectively of the post 23. Two set screws 61 extending through sidewall 57 of sleeve 49 and sidewall 31 of the post 23 fix the sleeve within the post.

Figure 5:
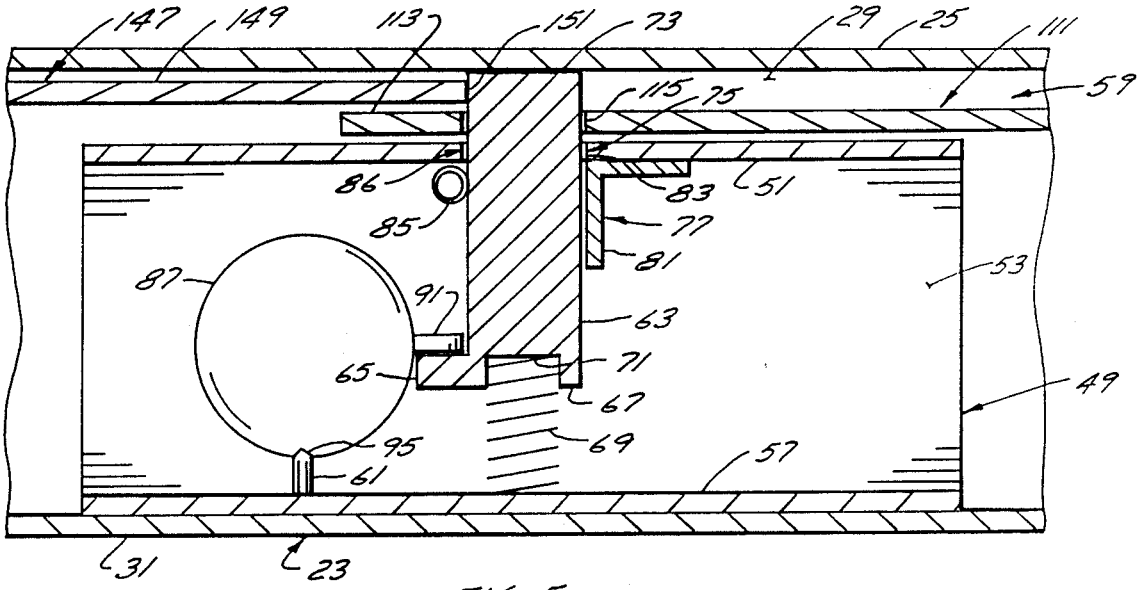
FIG. 5 is a view similar to FIG. 4 showing the locking pin in its locked position.

The locking pin assembly 35 as shown in FIGS. 3 and 4 includes a locking pin 63 mounted within the sleeve 49 for movement between locked and unlocked positions in a direction transverse to the post 23. The pin 63 has a flange 65 extending laterally from adjacent its inner end 67. A compression spring 69 is positioned between the inner end 67 of the pin 63 and the wall 57 of the sleeve 49. The spring 69 rests in a depression 71 formed in the inner end 67 of the pin 63 and biases the pin to the locked position toward the opposite first sidewall 51 of the sleeve 49 with the outer end 73 of the pin extending through an opening 75 in the first sleeve sidewall 51 to abut, or nearly abut the first post sidewall 25 as shown in FIG. 5. In the locked position, the pin 63 traverses the guide channel 59.

A guide bracket 77 can be fixed to the first sidewall 51 of the sleeve 49 by suitable fastening means (not shown) with one leg 81 of the bracket 77 aligned with one side 83 of the opening 75 in the sidewall 51. A roll pin 85 is mounted through the sidewalls 53, 55 of the sleeve 49, adjacent sidewall 51 and aligned with the other side 86 of the opening 75. The locking pin 63 is guided between the leg 81 of bracket 77 and the roll pin 85 into the opening 75. The locking pin 63 is also guided by the sidewalls 53, 55 of the sleeve 49 into the opening 75.

A key-operated cylindrical lock 87, 89 is mounted on each wide sidewall 27, 29 of the post 23. Each lock 87, 89 projects into the sleeve 49 passing through sidewalls 53, 55 respectively. A cam member 91, 93 projects from each lock 87, 89 within the sleeve 49. The set screws 61, fixing the sleeve 49 to the post 23, are elongated to fit into depressions 95 in the locks 87, 89 to hold the locks in place on the post 23. The cam members 91, 93 are normally located adjacent the top of the flange 65 on the locking pin 63 when the pin is in its locked position as shown in FIG. 5.

Figure 6:
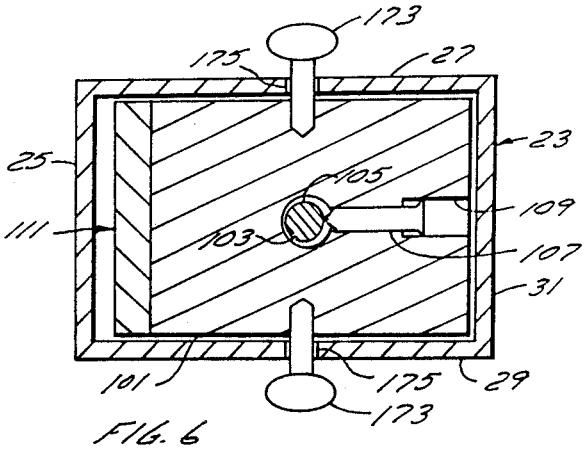
FIG. 6 is a cross-section view taken along line 6—6 in FIG. 2.

The top locking bar assembly 37 as shown in FIG. 2 is movable within the post 23 in the longitudinal direction of the post between a locked and unlocked position. The assembly 37 has a mounting block 101 with a through bore 103 therein as shown in FIG. 6. One end of a top locking bar 105 is loosely passed through the bore 103. A set screw 107, in a threaded transverse bore 109 that intersects bore 103 in the mounting block 101 locks the top locking bar 105 in position.

A rigid strap 111 is fastened to one side of the block 101 with suitable fastening means (not shown) and extends in a direction opposite to the locking top bar 105. The strap 111 is adjacent the first sidewall 25 of the post 23 and extends toward the middle of the post with its tail portion 113 passing through the guide channel 59 formed between the sidewall 25 of post 23 and sidewall 51 of sleeve 49. An opening 115 is provided in the tail portion 113 of the strap 111 as shown in FIG. 4 for receiving the locking pin 63 as will be described. The locking bar assembly 37 is slidably mounted within the post 23 with the locking bar 105 slidably passing through a bore (not shown) in a guide block 119 fixedly mounted within the post 23 adjacent its end 41. A screw or similar fastening means (not shown) mounts the block 119 within the post 23. A compression spring 121 is mounted about the locking bar 105 between the inner face 123 of the guide block 119 and the outer face 125 of the mounting block 101. The compression spring 121 biases the locking bar assembly 37 to an unlocked position with the free end 127 of the bar 105 just inside the end 41 of the post 23.

Figure 8:
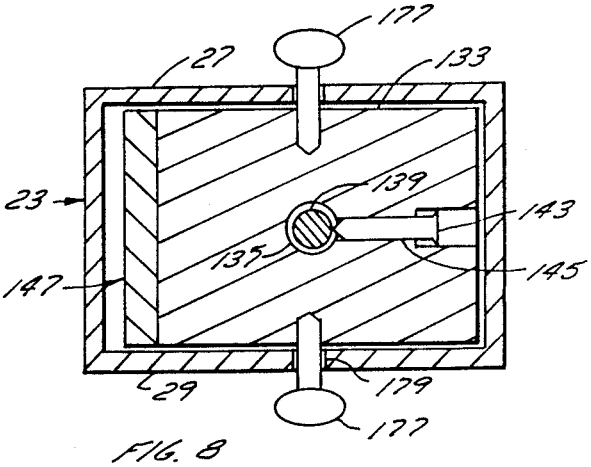
FIG. 8 is a cross-section view taken along line 8—8 in FIG. 2.

The bottom locking bar assembly 39 is also movable within the post 23 in the longitudinal direction of the post between a locked and unlocked position. The assembly 39 has a mounting block 133 with a through longitudinal bore 135 therein as shown in FIG. 8. A bottom locking bar 137 has a rod 139 projecting axially from its inner end 141 with the rod 139 passing loosely through the bore in the mounting block 133. A set screw 143, in a transverse bore 145 in the block 133 which intercepts bore 135 locks the rod 139, and thus locking bar 137 in its place. A strap 147 is fastened to one side of the block 133 with suitable fastening means (not shown). The strap 147 extends in a direction opposite to the rod 139 and locking bar 137. The strap 147 lies adjacent the first sidewall 25 of the post 23 and extends toward the middle of the post with its tail portion 149 passing through the guide channel 59. The tail portion 149 of the strap 147 is located between the tail portion 113 of the strap 111 and the sidewall 25 of the post 23. The free end edge 151 of the strap 147 acts as a stop edge against the locking pin 63 as will be described.

The locking bar assembly 39 is slidably mounted within the post 23 with the bottom locking bar 137 slidably passing through a bore (not shown) in a guide block 153. The guide block 153 is fixedly mounted within the post 23 adjacent its end 43. A screw or similar fastening means (not shown) mounts the block 153 within the post. A compression spring 155 is mounted about the locking bar 137 between the inner face 157 of the guide block 153 and the outer face 159 of the mounting block 133. The compression spring 155 biases the locking bar assembly 39 to an unlocked position with the free end 161 of the bar 137 just inside the end 43 of the post 23.

Preferably, adjustment means 165 are provided for adjusting the length of the locking bar 137 relative to the mounting block 133. The adjustment means 165 can comprise a slot 167 formed in the block 133 near its outer face 159 as shown in FIG. 2. The end of the rod 139 is threaded, and an adjustment nut 169, located in the slot 167, is threaded onto the rod 139 as the rod is mounted in the bore 135 of the block 133. The nut 169 is mounted in slot 167 in such a manner that it cannot turn. With the set screw 143 loosened, the bar 137 is rotated, via its free end 161, to adjust the location of the free end 161 relative to the end 43 of the post 23, the bar moving up or down relative to fixed nut 169. Access to set screw 143 can be through a slot (not shown) in the post 23 when the locking bar 137 is in an unlocked position.

Figure 7:
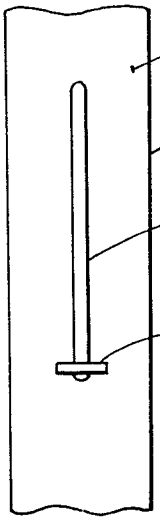
FIG. 7 is a detail side view of a portion of the post.

Two operating handles 173 are attached to the mounting block 101 through guide slots 175 in the wide sidewalls 27, 29 of the post 23 as shown in FIGS. 6 and 7. Either operating handle 173 is manually actuated to move the locking bar assembly 37 against the action of spring 121, to a locking position where the locking bar 105 projects out of the end 41 of the post 23. In the locking position, the opening 115 in the tail portion 113 of the strap 111 is generally aligned with the locking pin 63 and the string 69 moves the locking pin 63 transversely of the post 23 into the opening 115 to lock the locking bar assembly 37 in its locked position as shown in FIG. 5.

Two operating handles 177 are also attached to the mounting block 133 of the bottom locking bar assembly 39 through guide slots 179 in the wide sidewalls 27, 29 of the post 23 as shown in FIG. 8. Operation of either handle 177 moves the locking bar assembly 39 against the action of spring 155 to a locking position where the locking bar 137 projects out of the end 43 of the post 23. In the locking position, the end edge 151 of the strap 147 is just below the locking pin 63. The spring 69 moves the locking pin 63 past the end edge 151 of the strap 147 to hold the locking bar assembly 39 in its locked position when handles 177 are released as shown in FIG. 5. With the arrangement described, the top locking bar 105 must be locked before the bottom locking bar 137 can be locked.

In the locked position, the top locking bar 105, projecting from the top end 41 of the post 23, enters an opening 181 in the top frame member 11 while the bottom locking bar 137, projecting from the bottom end 43 of post 23, enters an opening 183 formed in the floor 9. Thus, in the locked position of the locking bar assemblies, both corners of the folding closure 3 are securely locked.

To unlock the closure, either cylinder lock 87, 89, on either side of the closure 3, is operated causing its respective cam 91, 93 to move the locking pin 63 via flange 65, against the action of the spring 69 to an unlocked position where it is withdrawn back past the end edge 151 of strap 147 and from the opening 115 in strap 111. The springs 121, 155 act to automatically move both locking bars 105, 137 to an unlocked position within the post 23 as the pin 63 is withdrawn thus unlocking the closure.

We claim:

1. A closure lock for a closure of the type having a tubular post at its leading end, the closure lock having two locking bar assemblies mounted within the post, each locking bar assembly having a locking bar at one end and a strap at the other end, the locking bars projecting in opposite directions and the straps overlapping, each locking bar assembly movable longitudinally within the post between a locked position where the locking bar projects from the post and an unlocked position where the locking bar is withdrawn in the post; a locking pin within the middle of the post and movable transversely of the post between a locked and unlocked position, the locking pin, in its locked position cooperating with the overlapped straps of the locking bar assemblies, when they are in their locked position, to prevent longitudinal movement of the locking bar assemblies within the post.

2. A closure lock as claimed in claim 1 including spring means biasing the locking pin to its locked position.

3. A closure lock as claimed in claim 2 including a cylinder lock fastened to each side of the post, either cylinder lock operable to move the locking pin against the spring means to an unlocked position away from the overlapped straps.

4. A closure lock as claimed in claim 1 including spring means biasing each locking bar assembly to its unlocked position.

5. A closure lock as claimed in claim 4 including manually operated means attached to each locking bar assembly and accessible outside the post to move the locking bar assembly against its biasing spring to its locked position.

6. A closure lock as claimed in claim 5 wherein the strap of one locking bar assembly has an opening in it to receive the locking pin, the strap with the opening located closest to the locking pin, the locking bar assemblies in their locked position having the strap with opening located to have the opening aligned with the locking pin and the other strap located with its end edge past the locking pin thereby allowing the locking pin to enter the opening of one strap and move past the end edge of the other strap, when moved to its locking position, to hold the locking bar assemblies in their locked position.

7. A closure lock as claimed in claim 6 including spring means biasing the locking pin to its locked position.

8. A closure lock as claimed in claim 7 including a cylinder lock fastened to the side of the post, either cylinder lock operable to move the locking pin against the spring means to an unlocked position out of the aligned openings.

9. A closure lock as claimed in claim 1 including means for adjusting the length of one of the locking bars in the locking bar assemblies.

10. A closure lock as claimed in claim 1 wherein each locking bar assembly includes a mounting block slidably mounted in the tubular post, the locking bar and strap of each assembly mounted to the mounting block, one of the locking bars adjustably mounted to its mounting block.

* * * * *